United States Patent [19]

Roberts et al.

[11] Patent Number: 4,860,892

[45] Date of Patent: Aug. 29, 1989

[54] FILM CONTAINER

[76] Inventors: Keith Roberts, 27520 N. Sierra Way, Suite F-208, Canyon Country, Calif. 91351; Thomas A. McConnell, 2912 Henrietta, La Crescenta, Calif. 91214

[21] Appl. No.: 258,917

[22] Filed: Oct. 17, 1988

[51] Int. Cl.[4] ..... B65D 85/67

[52] U.S. Cl. ..... 206/389; 215/230; 220/8; 220/82 R

[58] Field of Search ..... 220/8, 82 R, 82 A, 8; 215/365, 230; 206/389, 459, 316

[56] References Cited

U.S. PATENT DOCUMENTS

| | | | |
|---|---|---|---|
| 3,355,061 | 11/1967 | Ritter | 206/389 X |
| 4,509,656 | 4/1985 | Rosler | 220/8 |
| 4,596,340 | 6/1986 | Luther | 220/8 |
| 4,616,750 | 10/1986 | Nouwen | 206/389 X |
| 4,639,386 | 1/1987 | Akao | 206/316 X |
| 4,792,451 | 12/1988 | Kim | 220/8 |

FOREIGN PATENT DOCUMENTS

| | | | |
|---|---|---|---|
| 2817061 | 10/1979 | Fed. Rep. of Germany | 220/8 |

*Primary Examiner*—William Price

*Attorney, Agent, or Firm*—Gilbert Kivenson

[57] ABSTRACT

The film container is particularly adapted for roll film and includes a closed bottom open topped receptacle and a removable open bottom, closed top cap defining therebetween one or a pair of central spaces in which a film roll is held. The receptacle and/or cap has tapered sidewalls so that the cap and receptacle slidingly fit together and releasably lock and seal. The container may also include one or more indicators on the outer surface of the sidewall thereof which indicate whether the film roll inside the container is exposed or unexposed. The indicators may be, for example, an arrow on one of the receptacle and cap alignable with the words "exposed" and "unexposed", or symbols thereof, on the other of the receptacle and cap, or a single ridge matingly receivable on the receptacle or cap in either one of a spaced pair of labelled grooves on the other of the receptacle and cap. Colored ridges of the same or different configuration can be subsituted for the two grooves and ridge. Alternatively, a window in the receptacle sidewall can be provided through which the words "exposed" and "unexposed", or symbols thereof, on the cap sidewall can be separately viewed.

1 Claim, 2 Drawing Sheets

FILM CONTAINER

BACKGROUND OF THE INVENTION

1. Field of the Invention

The present invention generally relates to storage containers and more particularly to a film container of an improved type.

2. Prior Art

Various types of containers have been proposed in the past for holding rolls of camera film. See, for example, U. S. Pat. Nos. 3,490,578, 3,672,276, 4,615,442, 4,616,750 and 4,639,386. All of these, except 3,672,276, disclose cylindrical containers with screw top or clamp top lids. U.S. Pat. No. 3,672,276 is directed to a flat container.

One commonly used type of container is usually provided when unexposed roll film is purchased and comprises a cylindrical tube with a cylindrical removable clamp type cap. The cap may fit very closely over the tube and be difficult to put on and take off. Moreover, there is no way, without opening the container, of knowing whether or not the film inside the container is already exposed or not. Depending on the type of film spool upon which the film is wound, opening the container when exposed film is present therein could fog the film. It is also difficult to know, in some instances, whether the film has been exposed, even if the container is opened and the film roll is examined. Reusing exposed film will result in double exposures and ruined pictures.

It would be desirable to be able to provide a film container, preferably one adapted for roll film, which is easy to open and close and which positively but releasably locks. The container should also provide means to clearly indicate whether the film inside the container has been exposed or not. Such container should be provided in a variety of sizes, shapes, styles and configurations to suit various needs. It would also be desirable to have a container which hermetically seals the film.

SUMMARY OF THE INVENTION

The improved film container of the present invention satisfies all the foregoing needs. The container is substantially as set forth in the Abstract of the Disclosure. Thus, it comprises a generally cylindrical or generally rectangular or oval container, or the like with a film receptacle bottom portion and a removable top cap portion within both of which is a central film-retaining space. One or both of the receptacle and cap have sloped sidewalls. If the cap has tapered sidewalls, its open end is narrower than the closed end thereof. If the receptacle has tapered sidewalls, its open end is wider than its closed end. Accordingly, the cap and receptacle slidingly fit and releasably seals together perfectly, easily being openable and closeable.

Moreover, the outer surfaces of the sidewalls of the receptacle and cap contain means for indicating whether the film inside the container is exposed or unexposed. The indicators may be an arrow on one of the cap and receptacle, separately alignable with the spaced words "exposed" and "unexposed" or other marks on the other of the cap and receptacle. A single ridge may be substituted for the arrow and a spaced pair of grooves may be substituted for the words. Colored ridges of the same or different configuration can also be substituted for the two grooves and ridge. The receptacle may have a window through which the words "exposed" and "unexposed" on the cap can be separately viewed. A removable tab on the receptacle or cap can overlay the word "exposed" and also be used to releasably seal the cap and receptacle together. Additionally, means can be provided to indicate whether the container is empty or contains film therein. The container is simple, durable, inexpensive and efficient.

Various other features of the present invention are set forth in the following detailed description and accompanying drawings.

DRAWINGS

DETAILED DESCRIPTION

FIG. 1

Figure 1:
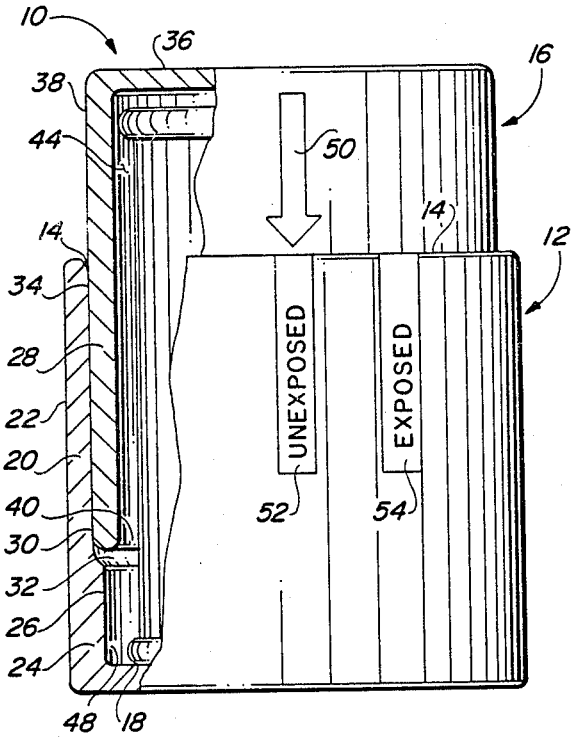
FIG. 1 is a schematic side elevation, partly broken away, of a first preferred embodiment of the improved container of the present invention, showing a roll of film in place therein.

A first preferred embodiment of the improved container of the present invention is schematically depicted in FIG. 1. Thus, container 10 is shown, which is generally cylindrical and comprises a bottom portion comprising a generally cylindrical receptacle 12 within the open top 14 thereof, an upper portion generally comprising a cylindrical cap 16 releasably received in receptacle 12.

Receptacle 12 has a closed flat horizontal bottom 18 integral with upraised sidewalls 20, the outer surface 22 of which is vertical, as is the lower portion 24 of the inner surface 26 thereof. The upper portion 28 of the inner surface 26 is narrower at its lower end 30 than portion 24, so as to form a ledge 32 therebetween. Moreover, upper portion 28 is sloped or tapered from lower end 30 to the upper end 34 thereof so as to be narrower at the upper end 34 than at lower end 30.

Cap 16 has a closed horizontal top 36, integral vertical depending sidewall 38 of uniform thickness and an open bottom 40. Cap 16 slip fits down within receptacle 12 and releasably locks thereto, the outer surface 42 of sidewall 38 being intercepted by the upper portion 28 of the inner surface 26 of sidewall 20 adjacent lower end 30, as shown in FIG. 1, due to the sloped nature of sidewall 20. Accordingly, cap 16 is releasably locked to receptacle 12 for a perfect fit.

Cap 16 defines a central space 44 and receptacle 12 defines central space 46 which communicates therewith when cap 16 is in place in receptacle 12, as shown in FIG. 1. Spaces 44 and 46 are adapted to retain film roll 48 or other film or film cartridge shielded from light.

Container 10 also includes means for indicating whether or not film roll 48 has been exposed. Thus, cap 16 includes a downwardly-pointing arrow 50 recessed in outer surface 42, while receptacle 12 contains marks 52 and 54 in the form of the words "unexposed" and "exposed" spaced laterally in outer surface 22. Cap 16 can be rotated so that arrow 50 points to the mark 52 or mark 54, indicating that film roll 44 has been unexposed or exposed.

Container 10 can be fabricated of metal, plastic, rubber, ceramic, wood, paperboard or the like inexpensively, and is durable, efficient and attractive. Since receptacle 12 is wider than cap 16, receptacle 12 serves as a sturdy base for container 10.

FIGS. 2-7

Figure 2:
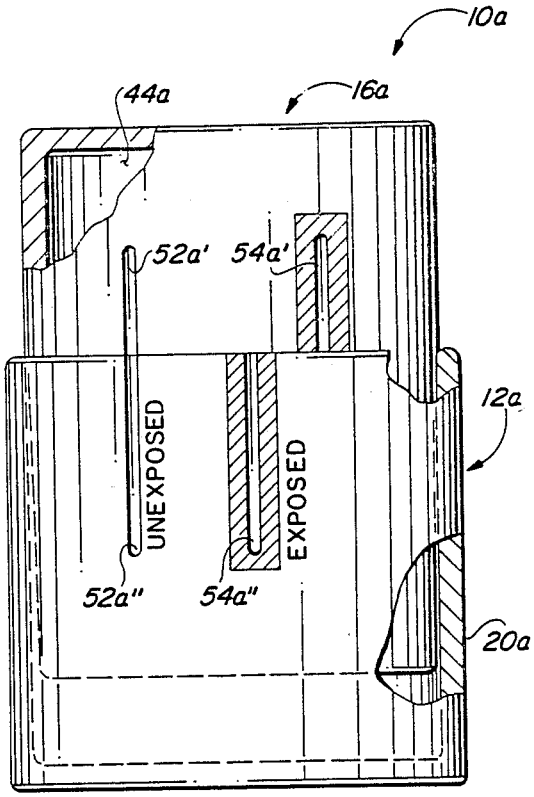
FIG. 2 is a schematic side elevation, partly broken away, of a second preferred embodiment of the improved container of the present invention.
Figure 3:
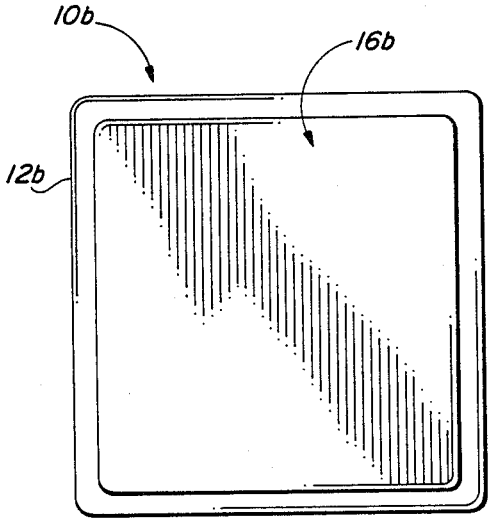
FIG. 3 is a schematic top plan view of a third preferred embodiment of the improved container of the present invention.
Figure 4:
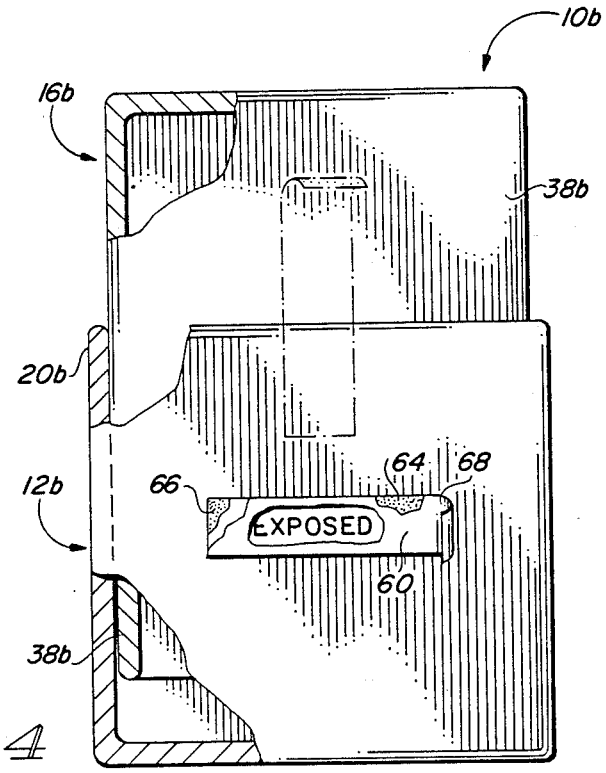
FIG. 4 is a schematic side elevation, partly broken away, of the container of FIG. 3.
Figure 5:
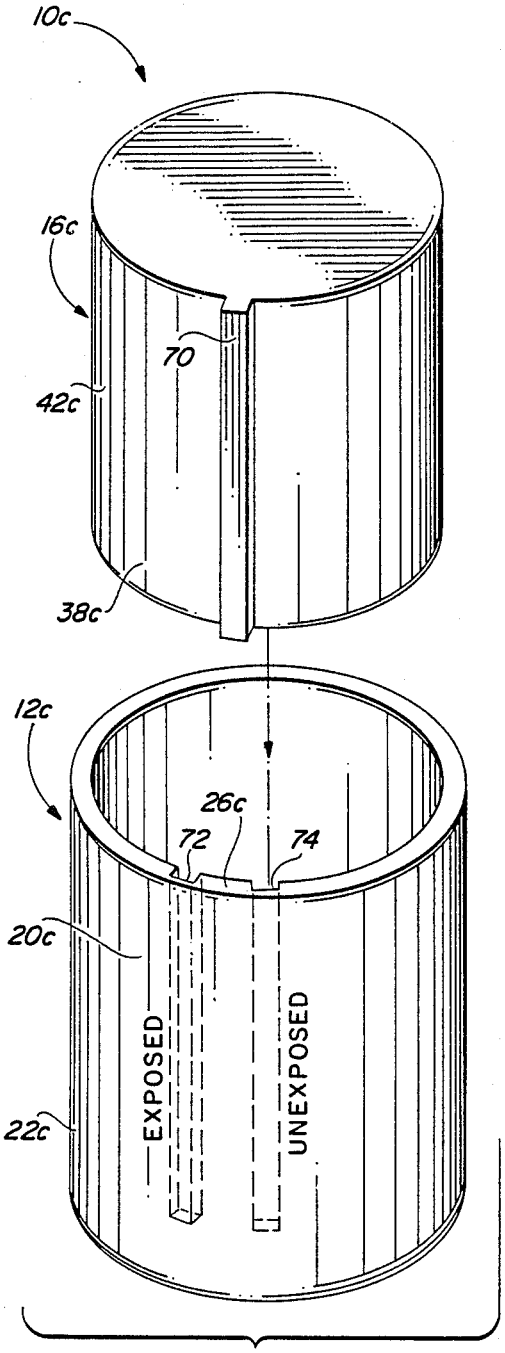
FIG. 5 is an exploded perspective view of a fourth preferred embodiment of the improved container of the present invention.
Figure 6:
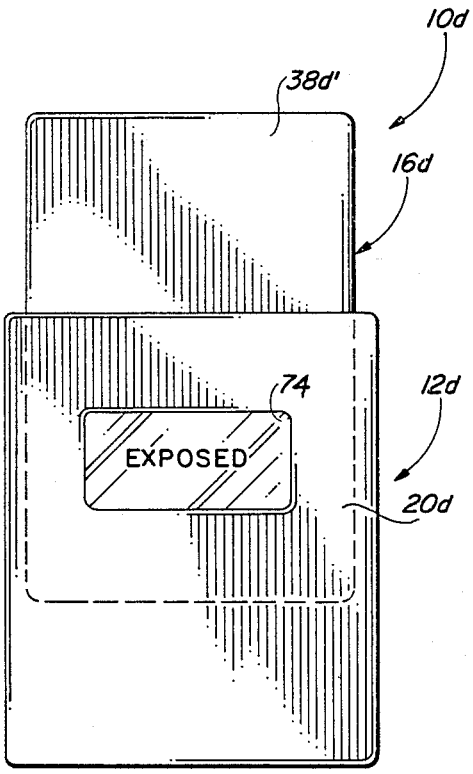
FIG. 6 is a schematic side elevation of a fifth preferred embodiment of the improved container of the present invention, showing one side of the cap thereof; and, FIG. 7 is a schematic side elevation of the cap of the container of FIG. 6, showing a second legend-bearing side.
Figure 7:
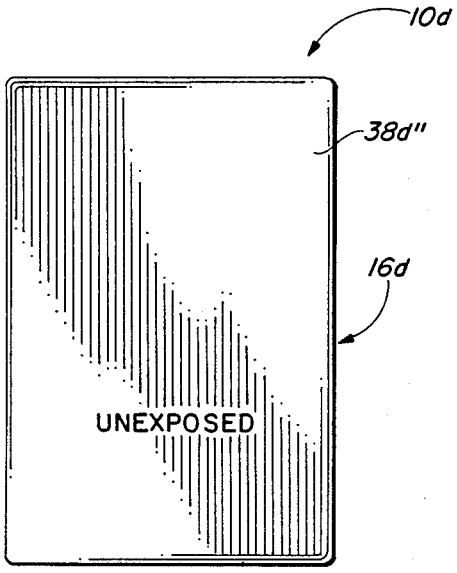

FIG. 2 depicts a second preferred embodiment of the present container. Thus, container 10*a* is shown. Components thereof similar to those of container 10 bear the same numerals but are succeeded by the letter "a". Similarly, FIGS. 3 and 4 depict a third embodiment 10*b*, FIG. 5 depicts a fourth embodiment 10*c* and FIGS. 6 and 7 depict a fifth embodiment 10*c*; components thereof similar to those of container 10 bear the same numerals but are succeeded by the appropriate letter.

FIG. 2

Container 10*a* of FIG. 2 is substantially identical to container 10, except as follows:

(a) cap 16*a* is tapered or sloped downwardly and inwardly so that space 44*a* is narrower at its lower end than at its upper end, while sidewall 20*a* is vertical and of uniform thickness; and, (b) there is no arrow; instead, the lower end of cap 16 bears a pair of grooves 52*a*', while the upper end of receptacle 12*a* bears matching grooves 52*a*'' and 54*a*''; grooves 54*a*' and 54*a*'' are wider than grooves 52*a*' and 52*a*''; grooves 52*a*' and 54*a*' are spaced farther apart laterally than are grooves 52*a*'' and 54*a*'', so that when grooves 52*a*' and 52*a*'' are aligned, grooves 54*a*' and 54*a*'' are out of alignment (see FIG. 2) and vice versa. Grooves 52*a*'' and 54*a*'' bear, respectively, the words "unexposed" and "exposed".

Container 10*a* has substantially the other advantages of container 10.

FIGS. 3 and 4

Container 10*b* is identical to container 10, except as follows:

(a) Container 10*b* is generally rectangular, and is square in top plan view, with cap 16*b* having sidewalls 38*b* thereof tapered downwardly inwardly, while sidewalls 20*b* are vertical and of uniform thickness; and, (b) the indicating means for container 10*b* is a tab 60 comprising a flexible strip of plastic, paper or the like connected to an underlying strip 62 by tacky adhesive 64. Strip 62 bears the legend "exposed" and is permanently connected to the outer surface 22*b* by adhesive 66. Tab 60 has a loose curled end 68 so that tab 60 can be easily pulled from strip 62 and can be adhesively connected to the junction of cap 16*b* and receptacle 12*b*, as shown in dotted outline in FIG. 4, to seal the same.

Container 10*b* has the other advantages of container 10.

FIG. 5

Container 10*c* is identical to container 10, except as follows:

the indicating means for container 10*c* comprises a raised vertical ridge 70 on the outer surface 42*c* of sidewall 38*c*, and a laterally spaced pair of vertical grooves 72 and 74 on the inner surface 26*c* of sidewall 20*c*, within either of which ridge 70 can slide. On the outer surface 22*c* of sidewall 20*c* and aligned with groove 72 is the legend "exposed". The legend "unexposed" is on surface 22*c* and is aligned with groove 74.

Container 10*c* has the other advantages of container 10.

FIGS. 6 and 7

Container 10*d* is identical to container 10, except as follows:

(a) container 10*d* is rectangular, and square in plan view, so that it is identical with container 10*b*, except that the indicating means of container 10*d* comprises a window 74 in sidewall 20*d* through which the legend "exposed" on sidewall 38*d*' can be viewed when container is assembled as shown in FIG. 6; the legend "unexposed" is on another sidewall 38*d*'' (FIG. 7) of cap 16*d* and can be viewed through window 74 when cap 16*d* is removed from receptacle 12*d*, rotated to align side 38*d*'' with window 74 and then reinserted into receptacle 12*d*.

Container 10*d* has the other advantages of container 10.

It will be understood that containers 10, 10*a*, 10*b*, 10*c* and 10*d* could be inverted and used in that position, with substantially similar results to those provided by the non-inverted upright positions described above.

Various other modifications, changes, alterations and additions can be made in the improved container of the present invention, its components and parameters. All such changes, modifications, alterations and additions as are within the scope of the appended claims form part of the present invention.

What is claimed is:

1. I claim: an indicating container for a roll of photographic film comprised of:

a. a hollow, cylindrical receptacle closed at one end with an inner wall of radially decreasing thickness along a major portion of the receptacle's length to form a tapering opening into the other end and containing a window in said wall;

b. a hollow, open-ended plug of a length similar to that of said receptacle having an outer wall of radially-decreasing thickness to form a taper which mates with the tapering opening in the receptacle to provide a close-fitting, frictionally held, releasable seal with the words "exposed" and "unexposed", to indicate the condition of the roll of photographic film, imprinted on the side of said plug at a position so as to be separably viewable in said window of the receptacle when the container is closed;

whereby a roll of film can be placed into the receptacle, the plug inserted and turned so that the word applicable to the condition of the film appears in the window and the seal completed by axial pressure between the plug and the receptacle.

* * * * *